United States Patent [19]

Abell

[11] 3,991,806

[45] Nov. 16, 1976

[54] STORM WINDOW CONSTRUCTION

[75] Inventor: Irwin R. Abell, Portland, Oreg.

[73] Assignee: Temp-Rite, Inc., Portland, Oreg.

[22] Filed: Dec. 8, 1975

[21] Appl. No.: 638,551

[52] U.S. Cl. ..... 160/90; 160/180; 160/354; 160/392; 160/395

[51] Int. Cl.[2] ..... A47H 13/00; E06B 3/32

[58] Field of Search ..... 160/90, 392, 395, 371, 160/327, 180, 393, 394, 396, 397, 354

[56] References Cited

UNITED STATES PATENTS

| | | | |
|---|---|---|---|
| 2,897,889 | 8/1959 | Kessler | 160/392 |
| 2,925,862 | 2/1960 | Sundby | 160/354 |
| 3,002,236 | 10/1961 | Humphner | 160/354 X |
| 3,143,165 | 8/1964 | Lewis et al. | 160/394 |
| 3,371,702 | 3/1968 | Keegan et al. | 160/392 |
| 3,908,730 | 9/1975 | Goss, Jr. et al. | 160/90 |

*Primary Examiner*—Philip C. Kannan
*Attorney, Agent, or Firm*—Klarquist, Sparkman, Campbell, Leigh, Hall & Whinston

[57] ABSTRACT

A storm window construction includes longitudinally grooved framing strips attached to the four faces of a window casing either inside or outside the window glass. Edge portions of a clear flexible plastic membrane stretched across the window opening and spaced from the glass are held within the grooves of the framing strips by bead strips to maintain the membrane under tension and provide an insulating air space between the membrane and the glass. The bead strips are oblong and can be inserted in the framing strip grooves only along the short diameter of the bead. Once in the groove the bead strip tends to rotate into wedging engagement with cylindrical inner wall portions of the groove under membrane tension to secure the bead and membrane in place. Surface portions of each bead strip intersected by its short diameter and portions of each framing strip at the entrance to the groove may be scored or toothed longitudinally to resist removal of the bead strip from the groove of the framing strip. One form of framing strip is channel-shaped in cross section and has an opening in its web portion and a slidable plastic insert for covering such opening. A second form of framing strip has two parallel grooves for receiving separate bead strips for securing two parallel spaced membranes to provide two insulating air layers between the window glass and the outermost membrane from the glass. A third form of framing strip has an integral window sash guide flange for replacing the conventional window sash guide molding found in older window constructions.

24 Claims, 6 Drawing Figures

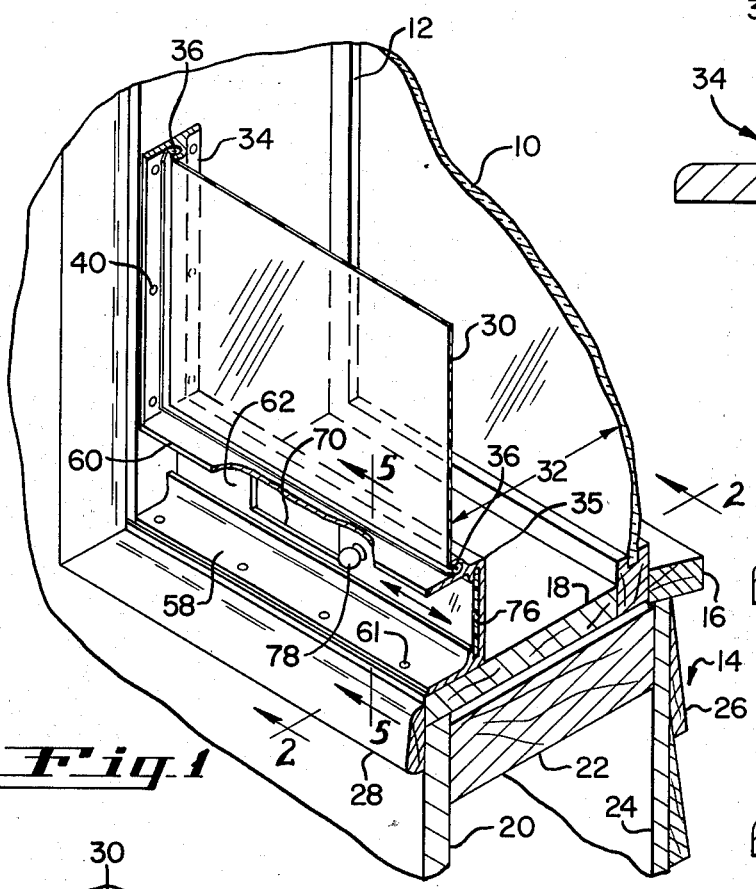
Fig. 1
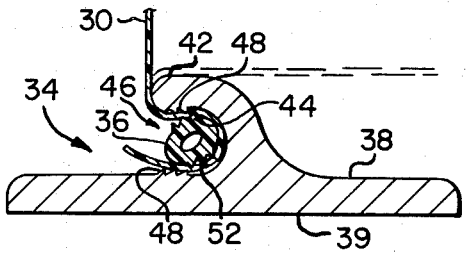
Fig. 3
Fig. 4
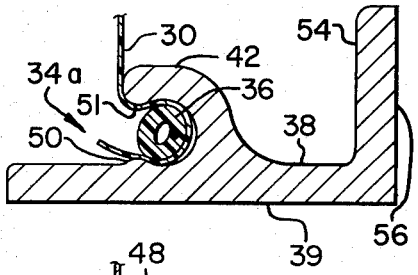
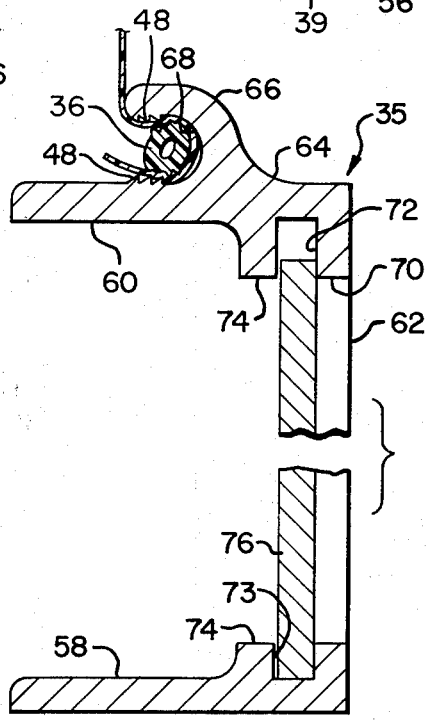
Fig. 5
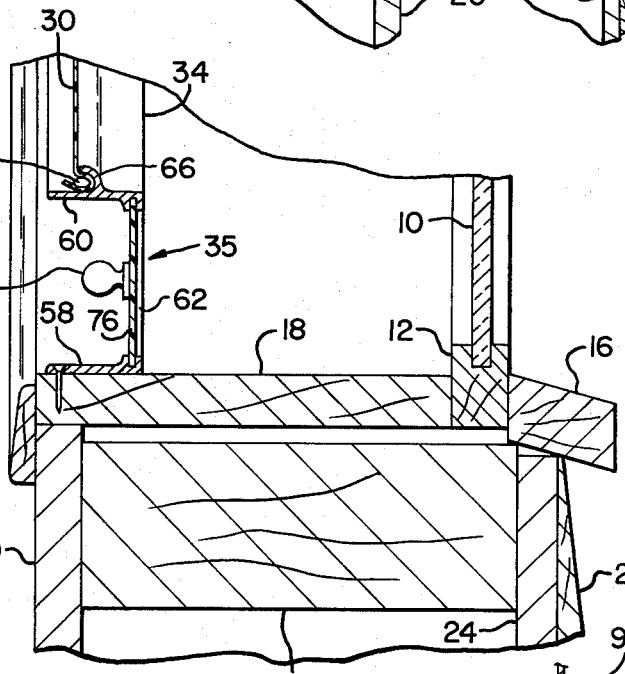
Fig. 2
Fig. 6
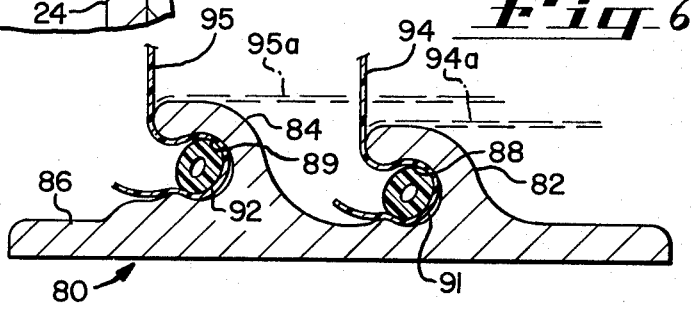

STORM WINDOW CONSTRUCTION

BACKGROUND OF THE INVENTION

1. Field of the Invention

The present invention relates to a storm window construction and more particularly to a storm window construction utilizing flexible clear plastic membranes stretched in parallel spaced relation to the window glass to provide an insulating layer of air between the glass and the membrane and to the means for securing the membrane to a window casing.

2. Description of the Prior Art

The use of a flexible clear plastic membrane attached to a window frame in parallel spaced relation to a pane of window glass to provide an insulating layer of air between the glass and the membrane is well known. Commonly the membrane is secured to the window frame outside of the glass using wooden framing strips nailed to the window frame. However, applying the membrane outside of the glass is often unsatisfactory because it may require climbing a ladder to reach the window, or the weather may be cold, rainy or windy, making installation difficult. Furthermore, wooden framing strips have proved unsatisfactory because they are usually made of poor quality thin wood lath and often splinter or split when nailed in place. Furthermore, such wooden strips are unsightly and detract from the appearance of the building. Also, with the membrane installed outside the window glass, it, too, becomes unsightly if not installed under sufficient tension, and furthermore can stretch or rip when exposed to extreme cold and higher winter winds.

Various types of framing strips and bead strips have been suggested for securing the edges of clear plastic film along opposite sides of a window opening. However, most such framing strips require that the strip be attached to the window frame itself, a molding associated with the frame or at the juncture of the window frame or its molding and the window casing, as exemplified by Keegan et al U.S. Pat. No. 3,371,702. Also in many cases special frames incorporating an integral membrane framing strip are used as exemplified by Saling U.S. Pat. No. 3,187,801.Framing strips that are applied directly to the window frame itself are shown in Commiso U.S. Pat. No. 3,068,939, and British Pat. No. 1,037,236. Attachment of a framing strip directly to the window frame or sash is often difficult, especially if the frame or sash is metal.

Framing strips commonly have a groove for receiving a complementary shaped bead strip for securing an edge portion of the clear plastic membrane within the groove of the framing strip. Such an arrangement is also shown, for example, in the previously mentioned Keegan et al, Saling and British patents. However, a common problem with such bead strips is that they tend to pull out of their grooves when the membrane is placed under tension between the bead and the walls of the groove.

Another common drawback of plastic window membranes is that they prevent the covered window from being opened to admit fresh air when desired.

SUMMARY OF THE INVENTION

The present invention is a storm window construction using a special framing strip and bead or dowel strip for simplifying the installation of a flexible clear plastic membrane on one side, and particularly the interior side, of a window glass. By adapting the framing strip and bead strip for installation on the inside of a window glass, the installation is inherently easier because the installer is not exposed to the weather and need not climb a ladder. In addition the installed membrane is protected by the glass itself from the elements and therefore remains in place once installed. Also, when installed inside a window glass, the membrane and its framing strips do not detract from the appearance of the window because the framing strips are unobtrusive. Furthermore, the framing strips of the invention are especially adapted for installation on the flat face of a window casing and have a low profile and attractive appearance so as not to detract from the appearance of the window in any event.

The framing strips can take several different forms for different applications, but all such forms have the same essential membrane-retaining feature. One form is provided with a fresh-air opening which can be selectively covered with a closure member. Another form has a built-in window sash guide to replace the molding guide strips on old-style upwardly sliding windows.

A particular feature of the framing strip and bead strip of the invention is their sturdy construction which enables them to be reused many times.

Another feature of the invention is a longitudinal groove in the framing strip of semicircular cross section and a bead of oval cross section so that when the bead is inserted in the groove of the framing strip along its short diameter, tension of the membrane wrapped partially around the bead within the groove tends to rotate the bead into wedging engagement with the walls of the groove to secure both the membrane and the bead against pull-out.

Another feature of the invention is a rigid framing strip and semiresilient bead strip with such bead strip having sufficient cross-sectional deformability to enable a slightly oversize bead strip to be inserted into the groove of the framing strip.

According to another feature of the invention the bead-confronting surfaces of the framing strip at the entrance opening to the groove may be provided with inwardly directed and longitudinally extending teeth or ridges and the bead may be provided with corresponding teeth or ridges along its surface portions intersected by its short diameter so as to resist pull-out of the bead from the groove. Alternatively the bead may have a smooth surface and the bead-confronting surfaces of the framing strip may be free of teeth but slightly raised so that the width of the entrance opening is less than the diameter of the groove.

According to still another feature of the invention, the bead is formed of an extruded tubular configuration to provide the bead with flexibility and limited resilience to facilitate its insertion into the groove of the framing strip.

A primary object of the invention is to provide an improved storm window construction which is inexpensive and easy to install.

Another primary object is to provide an improved storm window construction as aforesaid using a flexible plastic membrane and suitable framing and bead strips adaptable for use with a wide variety of window types and for securing the membrane to either a casing surface extending perpendicular to the window glass or other window frame surfaces extending parallel to the glass or even to frame surfaces extending at an oblique angle to the window glass.

Another object is to provide an improved storm window construction as aforesaid especially adapted for installation on the interior side of a window glass but also capable of installation on the exterior side of such glass.

Another object is to provide an improved storm window construction as aforesaid which is attractive in appearance when installed and which can either be kept in place permanently or removed if desired.

Another object is to provide an improved storm window construction as aforesaid including reusable framing strips and bead strips.

Another important object is to provide an improved storm window construction as aforesaid with an improved framing strip and bead strip assembly which develops a strong resistance to pull-out of the bead and membrane from the framing strip in use.

Another object is to provide an improved storm window construction as aforesaid with means for providing fresh air access through the storm window when desired.

The foregoing and other objects, features and advantages of the present invention will become more apparent from the following detailed description which proceeds with reference to the accompanying drawing.

BRIEF DESCRIPTION OF THE DRAWING

In the drawing:

FIG. 1 is a perspective view of a cut-away portion of a window assembly showing a storm window construction in accordance with the present invention;

FIG. 2 is a cross-sectional view of the window assembly of FIG. 1 including the storm window construction;

FIG. 3 is a cross-sectional view of one form of framing strip, bead strip and clear plastic membrane assembly of the invention as used in FIG. 1;

FIG. 4 is a cross-sectional view of a modified form of framing strip, bead and plastic membrane assembly in accordance with the invention;

FIG. 5 is a cross-sectional view of the bottom framing strip of FIG. 1, on an enlarged scale; and FIG. 6 is a cross-sectional view of another modified form of framing strip assembly of the invention.

DETAILED DESCRIPTION

With reference to FIGS. 1 and 2 of the drawing, a window assembly includes a pane of window glass 10 set in a window frame or sash 12 secured in place near the exterior of a building 14 by a window sill member 16 outside the window frame and a window casing 18 inside the window frame, such sill and casing comprising the window framework. Casing 18 is supported at its inside edge by the vertical inside wall partition 20. A horizontally extending framing member 22 extends between inside wall partition 20 and an outside wall partition 24. The outside wall partition is covered with exterior siding 26. The inside edge of casing 18 is covered by a molding strip 28.

A thin, clear, flexible plastic membrane 30 extends across the window opening defined by horizontal and vertical casing members 18 in parallel spaced relation to window glass 10 so as to confine an insulating dead air space 32 between window pane 10 and plastic membrane 30. The edge portions of membrane 30 are secured to the broad surfaces of casing members 18 by a framing strip assembly including opposed vertical framing strips 34, a special bottom framing strip 35, and a top framing strip (not shown) identical to side strips 34.

Bead or dowel strips 36 cooperate with such framing strips to secure the membrane to the framing strips.

The framing strips 34, 35 are preferably made of a rigid metal material such as an aluminum alloy extrusion for durability. The bead strips 36, however, are preferably a semiresilient plastic material extruded in a tubular shape for limited lateral resilience.

FIG. 3 Framing Strip Assembly

Referring to FIG. 3, framing strip 34 includes a base portion 38 having a flat bottom surface 39 for engagement with the flat outer surface of window casing 18. The base may be provided with fastener openings 40 (FIG. 1) at intervals along its length for securing the strip to the casing with screws or nails depending on whether the casing is metal or wood. If the casing is made of a hard metal or plastic material, the bottom surface 39 could also be coated with a pressure-sensitive adhesive film which would adhere to the casing surface without the use of fasteners. Such a securing means would have the advantage of not requiring the drilling of holes in the casing, but would be more difficult to remove than a framing strip secured with fasteners.

The framing strip also includes a lip portion 42 extending upwardly and outwardly from a central portion of the base and then toward one side of the base in overlying spaced relationship to the base to define a groove 44 extending inwardly from a groove entrance opening 46 at one side of the framing strip. The innermost wall portion of groove 44 is at least semicircular in cross section and of slightly larger diameter as measured from the lip to the base than the width of groove entrance opening 46 as measured from the outer free end of the lip to the base.

Bead strip 36 is preferably oval in cross section, as also shown in FIG. 3, and is preferably sized so that it can be inserted into groove 44 through groove opening 46 with an edge portion of the membrane only with its short diameter extending normal to the base 38 and with its long diameter extending generally parallel to the base of the framing strip. More specifically, the short diameter of oval bead strip 36 is preferably slightly less than the maximum diameter of the groove 44 and the long diameter of bead strip 36 is preferably slightly larger than the maximum diameter of groove 44, at least with a membrane lining the groove. Thus when the bead strip is inserted in the groove with an edge portion of the membrane and rotated, the opposite side surfaces of the bead strip intersected by its long diameter tend to wedge against the inner walls of the groove, securing the bead strip and plastic membrane 30 firmly in place within the groove and resisting pull-out of the membrane and bead therefrom.

The short diameter of bead member 36 may be slightly greater than the distance across groove opening 46 as measured between the lip and the base, at least with membrane 30 lining the groove. Therefore, to permit entry of such a bead strip into the groove, the bead is sufficiently resilient and deformable, because of its hollow construction, to collapse slightly upon entering the groove. After entering the groove, the bead expands to its normal diameter to become entrapped within the groove.

In the embodiment of FIG. 3, means are also provided at the groove entrance and preferably also on the bead member to resist withdrawal of the bead member from the groove. Such means includes a longitudinal raised protuberance in the form of a series of saw tooth ridges 48 extending longitudinally of the framing strip and directed inwardly toward the groove along base portion 38 and bead-confronting lip portion 42 at groove entrance 46. Such ridges need not be high, and in fact scoring would suffice in most cases instead of the ridges at these points. In fact, as shown in FIG. 4, slight raised protrusions 50, 51 of the base and lip, respectively, have been found to function satisfactorily to retain the bead within the groove.

Referring again to FIG. 3, to further resist withdrawal of the bead from the groove, additional bead retention means may be provided on the bead strip itself. The illustrated means includes a series of saw tooth ridges 52 similar to those on the framing strip and extending along the opposed outer surfaces of the bead intersected by its short diameter. The serrations or ridges on the bead are preferably directed away from the groove opening when the bead member is within the groove so as to interact with the saw tooth ridges of the framing strip in resisting withdrawal of the bead from the groove.

FIG. 4 Framing Strip Assembly

With reference to FIG. 4, a framing strip 34a is similar to framing strip 34 of FIG. 3, except for the smooth protrusions 50 and 51 previously noted instead of the saw tooth ridges 48 of the FIG. 3 framing strip. FIG. 4 also has an upstanding guide flange 54 along the rear edge of its base 38. Guide flange 54 has an outwardly facing flat guide surface 56 which extends at right angles to bottom surface 39. Framing strip 34a is intended for use along the inside of old-style windows in which the window sash 12 is designed to slide vertically within a guide track, the inside wall of which is formed on the inside of a window by a guide molding (not shown). Such a wooden guide molding on these old-style windows would normally prevent the installation of the vertical framing strips on the inside of the window in the manner shown in FIG. 1. To overcome this problem, the window guide moldings on the inside of such windows would simply be removed entirely and replaced with the framing strip 34a of FIG. 4. Framing strip 34a would be installed close to the window sash 12 so that the flat guide surface 56 of molding strip 34a guides the sash in its vertical sliding movement.

FIG. 5 Framing Strip

Referring now to FIG. 5 and also to FIGS. 1 and 2, the bottom framing strip 35 for securing the membrane to the window casing is generally channel-shaped in cross section. It includes a bottom flange 58 and a parallel top flange 60 joined by a vertical web portion 62. Top flange 60 has an upper surface 64 provided with an upwardly and then outwardly extending lip portion 66 similar to lip portion 42 of the FIG. 3 form of framing strip and including the saw tooth ridge portions 48 at the entrance to the semicylindrical bead groove 68. Bottom flange 58 is provided with fastener holes 61 (FIG. 1) at intervals along its length for securing the framing strip to the upper surface of lower window casing 18. Web 62 has a rectangular fresh air access opening 70 therethrough for permitting fresh air to enter from outside of the building into the room. Vertically aligned upper and lower guideways 72, 73, respectively, are defined by lip portions 74 of the upper and lower flanges 60, 58 and the spaced inner surfaces of vertical web portion 62. Guideways 72, 73 receive a thin rectangular plastic or metal closure member 76 which can be slid in the guideways along the web portion 62 to open and close access opening 70. As shown in FIGS. 1 and 2, closure member 76 has an inwardly projecting handle 78 for sliding the closure member along its guideways.

FIG. 6 Framing Strip Assembly

FIG. 6 shows a framing strip, bead strip and plastic membrane storm window assembly similar in principle to that of FIG. 3. However, the assembly has a modified framing strip 80 provided with two lip portions 82, 84 spaced apart across the width of the strip. The lips and a base 86 define a pair of grooves 88, 89 similar to the groove 44 of FIG. 3. Each groove 88, 89 receives a separate oval bead strip 91, 92, with each such strip similar to those used in the assemblies of FIGS. 3 and 4. The beads 91, 92 are not provided with saw tooth ridges, nor are the groove entrances, although they could be if so desired.

Each of the two bead strips and their cooperative grooves is adapted to receive a separate membrane 94, 95. When secured within their respective grooves by beads 91, 92, such membranes extend parallel and in spaced relation to one another and parallel to a window glass (not shown) to form with such window glass two insulating dead air spaces. The double spaces provide even better insulating properties than provided by the single-groove frame strips of FIGS. 3, 4 and 5.

Preferably lip portion 84 is positioned at a higher level than lip portion 82 with respect to base 86 so that the strip can be mounted either perpendicular or parallel to the window glass. If the framing strip cannot be mounted on the surface of a window casing, but must be mounted on a window frame surface parallel to the window glass, the membranes 94, 95 can be extended in a direction parallel to the base as indicated at **94*a*, 95*a*** and still provide two insulating air spaces between the window glass and two membranes.

OPERATION

The membrane-securing function is the same for the four different framing strips shown and described.

In practice, framing strips 34 are fastened to the broad outer surfaces of flat side and top casing members 18 parallel to and spaced equally from the window glass 10. The bottom framing strip 35 is attached to the bottom casing 18 in a similar manner. If desired, the framing strips may be provided in long lengths which may then be cut to desired lengths by the user for installation, depending on window size. The bead strips would be provided in similar long lengths. This would enable the assembly to be sold in a package to accomodate window openings of various sizes. The framing strips are installed at a desired distance from the window glass 10, as indicated at 32, to provide a dead air space between such glass and membrane 30. The lip portions of all four framing strips extend outwardly away from the window glass toward the interior of the building so that the groove openings face outwardly away from the window glass.

With the framing strips installed as described, a clear plastic membrane is cut to the approximate size of the window opening, but slightly oversize. One edge portion of the membrane is inserted into the groove of one of the four framing strips surrounding the window opening. Then the bead for that framing strip is inserted into such groove by pressing or hammering, if necessary, with the short diameter of the bead perpendicular to the base of the framing strip. The membrane is then pulled taut across the window opening toward the framing strip opposite the one secured edge of the membrane. The free opposite edge portion of the membrane is wrapped partially about another bead strip for the opposite framing strip, and then such bead strip is pressed or hammered into the groove of the opposite framing strip, pulling the membrane tight across the window opening. Now the same procedure is repeated along the remaining two free edge portions of the membrane to secure such edge portions within the grooves of the other two opposed framing strips.

With this completed, the membrane is stretched taut across the window opening and secured firmly in place by the bead strips within the grooves of the framing strips. The greater the tension or pulling forces exerted by the membrane on the beads within their grooves, the greater is the wedging action of the beads against the walls of the grooves to hold the membrane in place, because of the tendency of the membrane to rotate the beads into wedging cooperation with the walls of the grooves.

If an old-style, vertically sliding window having the window frame slidable between inner and outer molding guide strips is to be covered with a membrane, such molding strips may have to be removed from inside the window and replaced with the combination window guide-framing strip 34a of FIG. 4 before the membrane can be installed. However, after the guide-framing strips are in place with guide surface 56 against the window frame, installation of the membrane proceeds as previously described.

If double membranes are desired to provide two air spaces, framing strips 80 of FIG. 6 would be used instead of the strips 34.

If no fresh air opening through the storm window is needed, framing strips 34 or 34*a* may be used on all four sides of the window opening, instead of using the special strip 35. Conversely, if multiple fresh air openings are desired, the framing strips 35 could be used along more than one side of the window opening.

Having illustrated and described the principles of the invention with reference to what are presently several preferred embodiments, it should be apparent to those skilled in the art that the invention may be modified in arrangement and detail without departing from such principles. I claim as my invention all such modifications as come within the true spirit and scope of the following claims.

I claim:

1. In a storm window construction in which a flexible, transparent membrane is stretched over a window opening on one side of a pane of window glass to trap an insulating layer of air between said pane and said membrane, a means for securing the edges of said membrane in tension to window framework surrounding said opening comprising:

framing strips adapted for attachment to all four sides of said framework in parallel spaced relation to said pane, and bead strips cooperable with said framing strips for securing opposed edge portions of said membrane to said framing strips to place said membrane in tension, each said framing strip including a longitudinal groove extending inwardly of said framing strip from a groove entrance opening along one side of said framing strip, said groove being bounded by a base portion of said strip and a lip portion projecting outwardly from and in overlying spaced relation to said base portion and defining said groove opening therebetween, at least the innermost portion of said groove inwardly of said entrance opening being circular in cross section, said bead strips being of oval cross section and being sized so as to be insertable into said groove with a bight of said membrane only with the short axis of said bead strips extending across said groove opening, such that a bight of said membrane in tension when inserted in said groove with said oval bead strip tends to rotate said oval strip into wedging cooperation with circular wall portions of said groove to secure said bight within said groove.

2. A storm window construction according to claim 1 wherein the width of said bead strip along its long axis is slightly greater than said maximum diameter of said groove and the width dimension of said bead strip along its short axis is slightly less than the maximum diameter of said groove so that rotation of said oval bead strip within said circular groove portion tends to wedge said bead strip against the circular walls of said groove.

3. A storm window construction according to claim 1 wherein said oval bead strip has saw tooth ridge portions on opposite surface portions thereof intersected by the short axis of said bead strip so as to resist removal of said bead member from said groove when said bead strip is inserted into said groove with said ridges directed outwardly thereof.

4. A storm window construction according to claim 1 wherein said bead strip is of a tubular construction to provide said bead strip with limited compressibility.

5. A storm window construction according to claim 1 wherein said framing strip is composed of an extruded rigid metal and said bead strip is composed of an extruded tubular plastic material.

6. A storm window construction according to claim 1 including means on bead-confronting surfaces of said lip and base portions of said framing strip at said groove opening for resisting the removal of said bead strip from said groove.

7. A storm window construction according to claim 1 wherein said bead strip includes means on opposed surface portions thereof intersected by the short axis thereof for cooperation with bead-confronting surface portions of said groove for resisting removal of said bead strip from said groove.

8. A storm window construction according to claim 1 wherein said framing strips include a framing strip having a base portion terminating at one side in an upstanding guide flange portion normal to said base portion and having a flat outwardly facing guide surface for guiding a vertically slidable window sash.

9. A storm window construction according to claim 1 wherein the width of said entrance opening as measured between said lip portion and said base portion is less than the maximum diameter of said groove inwardly of said entrance opening.

10. A storm window construction according to claim 9 wherein the diameter of said bead along its short axis is less than the maximum diameter of said groove and the diameter of said bead along its long axis is greater than the maximum diameter of said groove.

11. A storm window construction according to claim 1 wherein at least one of said lip and base portions of said framing strip at said groove opening are provided with saw tooth ridges directed inwardly of said opening and extending longitudinally of said framing strip so as to resist removal of said bead strip from said groove.

12. A storm window construction according to claim 11 wherein said oval bead strip has saw tooth ridge portions on opposite surface portions thereof intersected by the short axis of said bead strip so as to interact with said saw tooth ridge portions of said framing strip to resist removal of said bead member when inserted in said groove with the ridge portions of said bead member directed outwardly of said groove.

13. A storm window construction according to claim 1 wherein two said membranes are stretched between opposite sides of said window casing in parallel spaced relation to one another and to said window glass, each said framing strip comprising two said grooves extending parallel to one another each defined by separate lip portions of said strip, both said grooves opening in the same direction, and a separate said bead strip for each said groove.

14. A storm window construction according to claim 13 wherein one said groove is at a greater elevation above said base portion of said framing strip than the other said groove.

15. A storm window construction according to claim 1 wherein said base portion at the entrance opening of said groove has a raised ridge protrusion extending inwardly of said opening toward an opposed said lip portion to help retain said bead strip within said groove.

16. A storm window construction according to claim 15 wherein an outer end of said lip portion extends inwardly of said opening toward said raised ridge protrusion to help retain said bead strip within said groove.

17. A storm window construction according to claim 1 wherein said framing strip is generally channel-shaped in cross section including a top flange portion comprising said base portion, a bottom flange portion and an interconnecting web portion, said web portion having a fresh air access opening extending therethrough, and closure means movably mounted on said framing strip for selective opening and closing of said access opening.

18. A storm window construction according to claim 17 wherein said framing strip includes means defining a guideway for slidably mounting said closure means along said web portion to open and close said access opening.

19. In a storm window construction in which a flexible, transparent membrane is stretched over a window opening on one side of a pane of window glass to trap an insulating layer of air between said pane and said membrane, a means for securing the edges of said membrane in tension to window framework surrounding said opening comprising:

framing strips adapted for attachment to all four sides of said framework in parallel spaced relation to said pane, and bead strips cooperable with said framing strips for securing opposed edge portions of said membrane to said framing strips to place said membrane in tension, each said framing strip including a longitudinal groove extending inwardly of said framing strip from a groove entrance opening along one side of said framing strip, said groove being bounded by a base portion of said strip and a lip portion projecting outwardly from and in overlying spaced relation to said base portion and defining said groove opening therebetween, at least the innermost portion of said groove inwardly of said entrance opening being circular in cross section, said framing strips being composed of a rigid extruded metal, the width of said entrance opening as measured between said lip portion and said base portion being less than the maximum diameter of said groove inwardly of said entrance opening to aid retention of a said bead strip within said groove, said bead strips being composed of an extruded tubular plastic material having a slightly deformable cross section because of its tubular nature to enable insertion of said bead with said membrane into said groove through said entrance openings.

20. A storm window construction according to claim 19 wherein said base portion at the entrance opening of said groove has a raised ridge protrusion extending inwardly of said opening toward an opposed said lip portion to help retain said bead strip within said groove.

21. A storm window construction according to claim 19 wherein said framing strips include a framing strip having a base portion terminating at one side in an upstanding guide flange portion normal to said base portion and having a flat outwardly facing guide surface for guiding a vertically slidable window sash.

22. A storm window construction according to claim 16 wherein said bead strip has an oval cross-sectional shape.

23. A storm window construction according to claim 19 wherein said framing strip is generally channel-shaped in cross section including a top flange portion comprising said base portion, a bottom flange portion and an interconnecting web portion, said web portion having a fresh air access opening extending therethrough, and closure means movably mounted on said framing strip for selective opening and closing of said access opening.

24. A storm window construction according to claim 23 wherein said framing strip includes means defining a guideway for slidably mounting said closure means along said web portion to open and close said access opening.

* * * * *

UNITED STATES PATENT AND TRADEMARK OFFICE

CERTIFICATE OF CORRECTION

PATENT NO. : 3,991,806

DATED : November 16, 1976

INVENTOR(S) : IRWIN R. ABELL

It is certified that error appears in the above-identified patent and that said Letters Patent are hereby corrected as shown below:

Column 8, line 15, claim 1, after "oval" insert --bead--;

Column 10, line 43, claim 22, change "claim 16" to --claim 19--.

Signed and Sealed this

First Day of March 1977

[SEAL]

*Attest:*

RUTH C. MASON
*Attesting Officer*

C. MARSHALL DANN
*Commissioner of Patents and Trademarks*